US008123032B2

(12) United States Patent
Shiao

(10) Patent No.: US 8,123,032 B2
(45) Date of Patent: Feb. 28, 2012

(54) ROTATE BOTTOM BASE ASSEMBLY FOR A GOLF STAND BAG AND GOLF STAND BAG WITH A ROTATE BOTTOM BASE ASSEMBLY

(76) Inventor: Kun-Lin Shiao, Yangmei Chen (TW)

( * ) Notice: Subject to any disclaimer, the term of this patent is extended or adjusted under 35 U.S.C. 154(b) by 385 days.

(21) Appl. No.: 12/500,809

(22) Filed: Jul. 10, 2009

(65) Prior Publication Data

US 2011/0005949 A1 Jan. 13, 2011

(51) Int. Cl.
*A63B 55/04* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS 5,829,719 A * 11/1998 Han ..... 248/96
6,168,123 B1 * 1/2001 Stein et al. ..... 248/96
6,325,208 B1 * 12/2001 Cheng ..... 206/315.7
6,581,767 B2 * 6/2003 Cheng ..... 206/315.7
7,445,115 B2 * 11/2008 Tan ..... 206/315.7
2003/0034262 A1 * 2/2003 Cheng ..... 206/315.7
2006/0006086 A1 * 1/2006 Fair et al. ..... 206/315.7
2006/0278768 A1 * 12/2006 Shiao ..... 248/96

* cited by examiner

*Primary Examiner* — Tri Mai
(74) *Attorney, Agent, or Firm* — C. G. Mersereau; Nikolai & Mersereau, P.A.

(57) ABSTRACT

A golf stand bag has a rotate bottom base assembly, a supporting rod, a top frame, a body, two legs and an activating member. The rotate bottom base assembly has a rotate bottom base and a pivot bracket. The rotate bottom base has a bottom, a sidewall formed on the bottom and two pivot balls formed on the sidewall. The pivot bracket has two pivot members pivotally mounted respectively on the pivot balls. The supporting rod is mounted securely on the pivot bracket. The top frame is mounted on the supporting rod. The legs are mounted pivotally on the top frame. The activating rod is mounted on the rotate bottom base and connected to the legs. The pivot bracket mounted on the sidewall instead the bottom of the rotate bottom base prevent the legs of the golf stand bag from inadvertently extending out the legs when the golf stand bag leans against a wall.

11 Claims, 8 Drawing Sheets

ROTATE BOTTOM BASE ASSEMBLY FOR A GOLF STAND BAG AND GOLF STAND BAG WITH A ROTATE BOTTOM BASE ASSEMBLY

BACKGROUND OF THE INVENTION

1. Field of the Invention

The present invention relates to a frame, and more particularly to a golf stand bag that has a rotate bottom base assembly and two legs. The rotate bottom base assembly selectively inclines the golf stand bag to extend the legs out so that the golf stand bag stands obliquely on the ground.

2. Description of Related Art

Golf bags hold golf clubs. A conventional golf bag is cylindrical and has a flat bottom so that the golf bag can stand upright on the ground. However, the grassy of most golf courses is not flat. A golf bag standing on the grass may easily fall over. Therefore, a golfer lays the golf bag on the floor and may tire easily due to stooping to lift up and lay down the golf bag.

With reference to FIG. 8, another conventional golf bag with an integral bipod stand can stand stably on sloping grass and comprises a bag body (91), two legs (92), a pivot bracket (93), two activating rods (94) and multiple guide brackets (95). The bag body (91) has an open top, a bottom and a sidewall. The legs (92) are attached pivotally on the sidewall of the bag body (91) close to the top, and each leg (92) has a proximal end. The pivot bracket (93) is mounted pivotally on the bottom of the bag body (91), has a flat bottom and contacts the ground when the golf bag (91) stands on the ground. The activating rods (94) are connected pivotally to the pivot bracket (93), and each activating rod (94) has a distal end. The distal ends of the activating rods (94) are pivotally attached respectively to the legs (92) near the proximal ends of the legs (92). The guides (95) are mounted on the sidewall, and each guide (95) has two through holes through which the activating rods (94) respectively extend. Inclining the bag body (91) relative to the pivot bracket (93) causes the activating rods (92) to pivot the legs (92) away from the bag body (91) so that the golf bag can stand obliquely and stably on the ground.

However, the pivot bracket (93) is exposed out of the bottom of bag body (91). Therefore, when a user leans the golf bag on a wall without intentionally standing the golf bag obliquely, the pivot bracket (93) easily presses against the ground and pivots relative to the bottom to inadvertently extend the legs (92).

To overcome the shortcomings, the present invention provides a rotate bottom base assembly for a golf stand bag to mitigate or obviate the aforementioned problems.

SUMMARY OF THE INVENTION

The main objective of the invention is to provide a golf stand bag that has a rotate bottom base assembly and two legs. The rotate bottom base assembly selectively inclines the golf stand bag to extend the legs out so that the golf stand bag stands obliquely on the ground.

A golf stand bag in accordance with the present invention has a rotate bottom base assembly, a supporting rod, a top frame, a body, two legs and an activating member. The rotate bottom base assembly has a rotate bottom base and a pivot bracket. The rotate bottom base has a bottom, a sidewall formed on the bottom and two pivot balls formed on the sidewall. The pivot bracket has two pivot members pivotally mounted respectively on the pivot balls. The supporting rod is mounted securely on the pivot bracket. The top frame is mounted on the supporting rod. The legs are mounted pivotally on the top frame. The activating rod is mounted on the rotate bottom base and connected to the legs.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
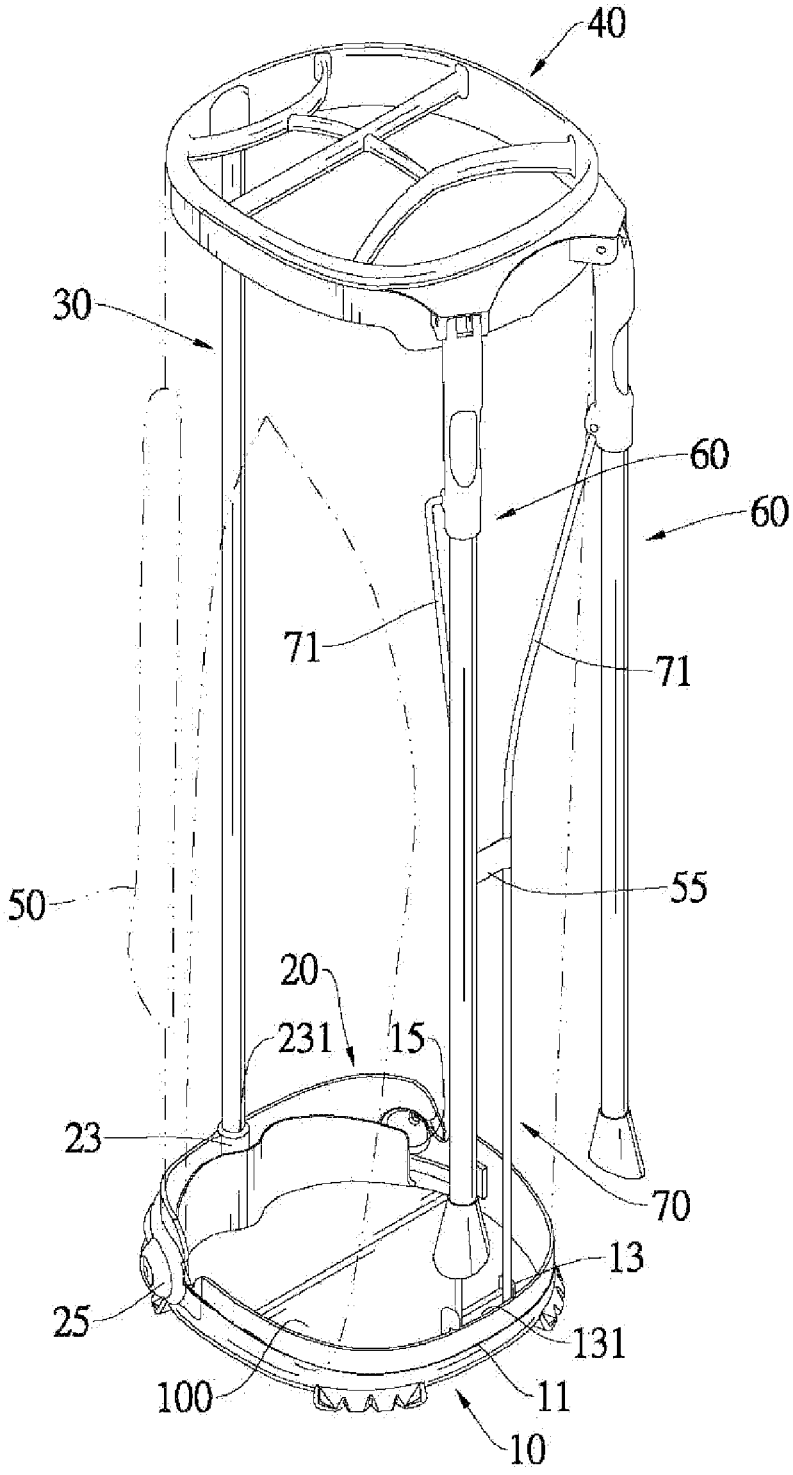
FIG. 1 is a perspective view of a golf stand bag in accordance with the present invention.
Figure 3:
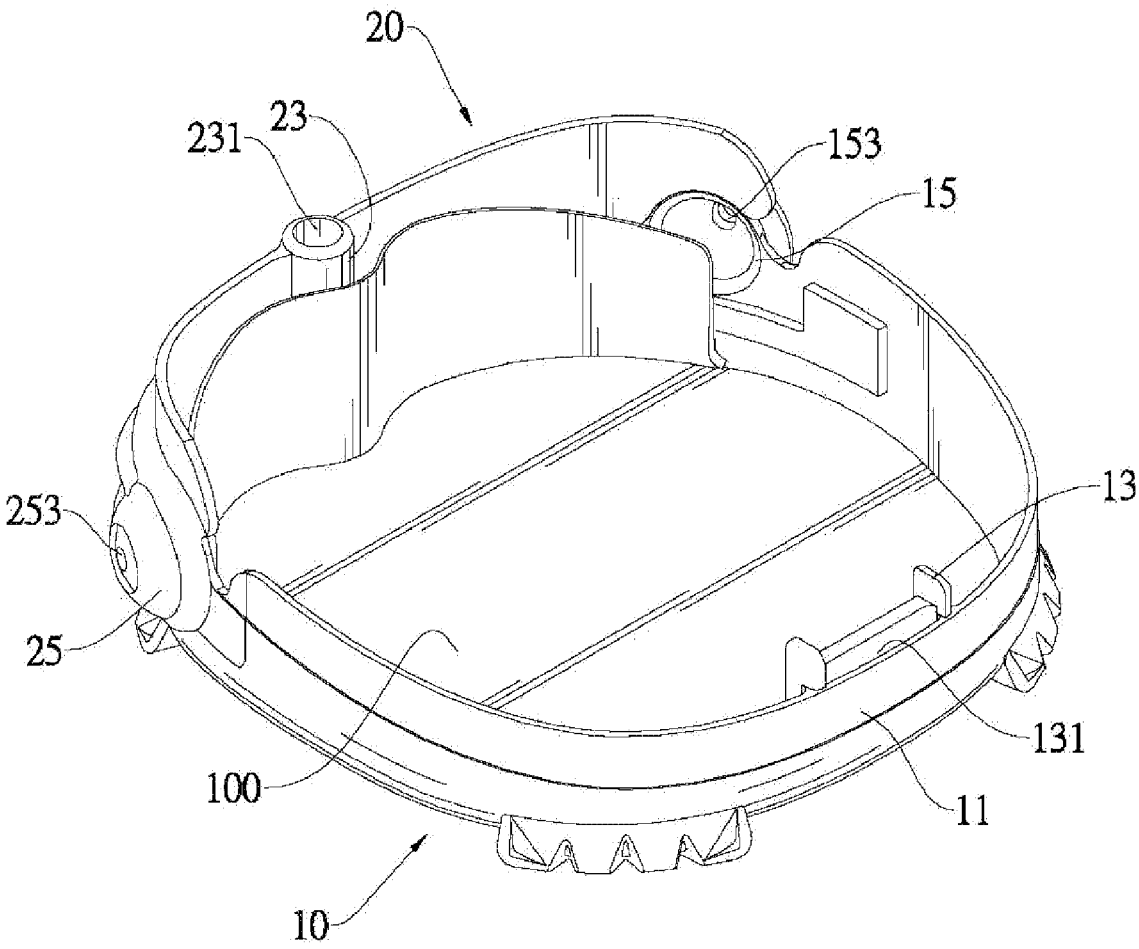
FIG. 3 is a perspective view of the rotate bottom base assembly of the golf stand bag in FIG. 1 without pivot pins.
Figure 4:
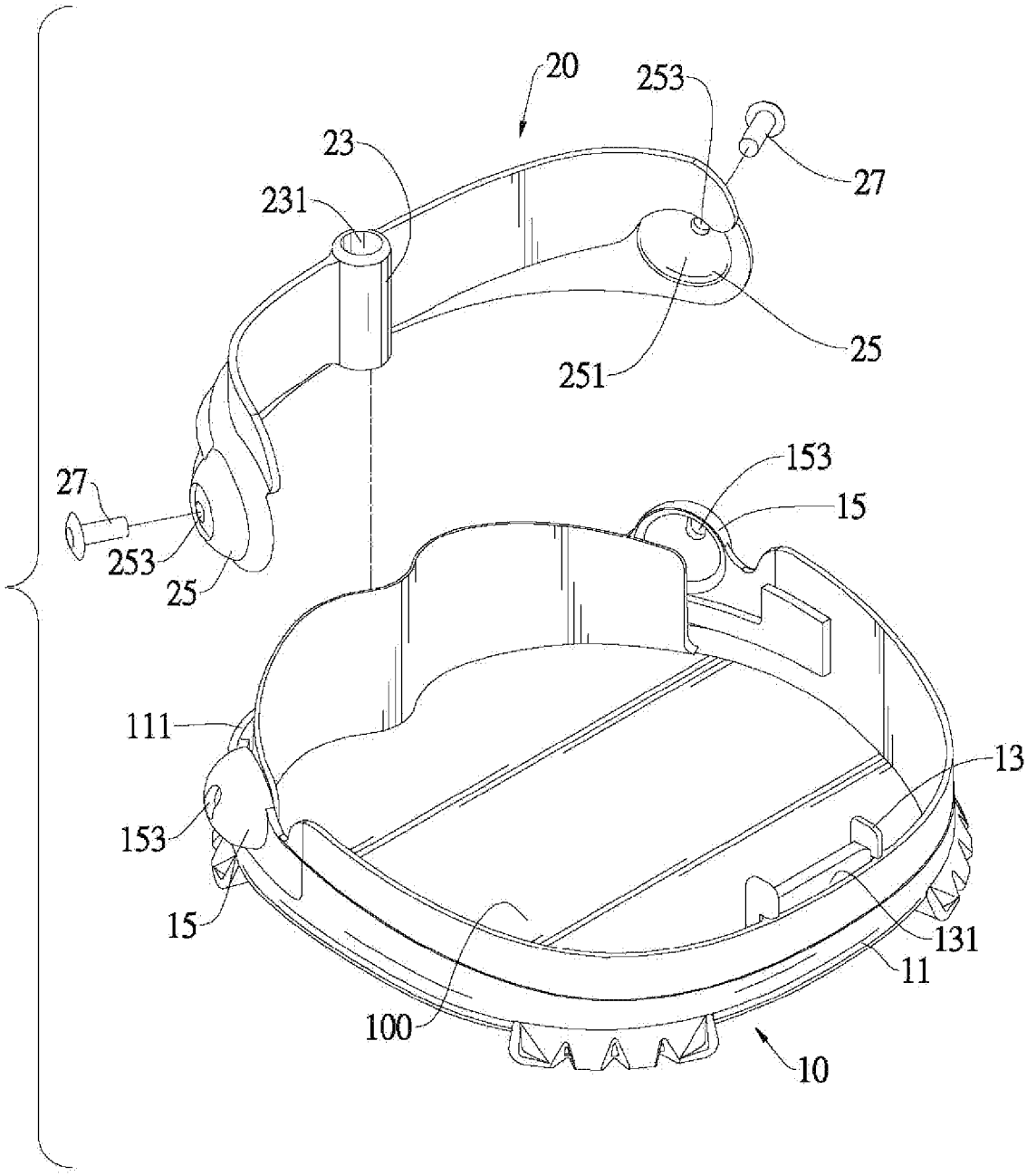
FIG. 4 is an exploded perspective view of the of the rotate bottom base assembly of the golf.

With reference to FIGS. 1, 3 and 4, a golf stand bag in accordance with the present invention comprises a rotate bottom base assembly, a supporting rod (30), a top frame (40), a body (50), two legs (60) and an activating member (70).

The rotate bottom base assembly in accordance with the present invention comprises a rotate bottom base (10) and a pivot bracket (20).

Figure 5:
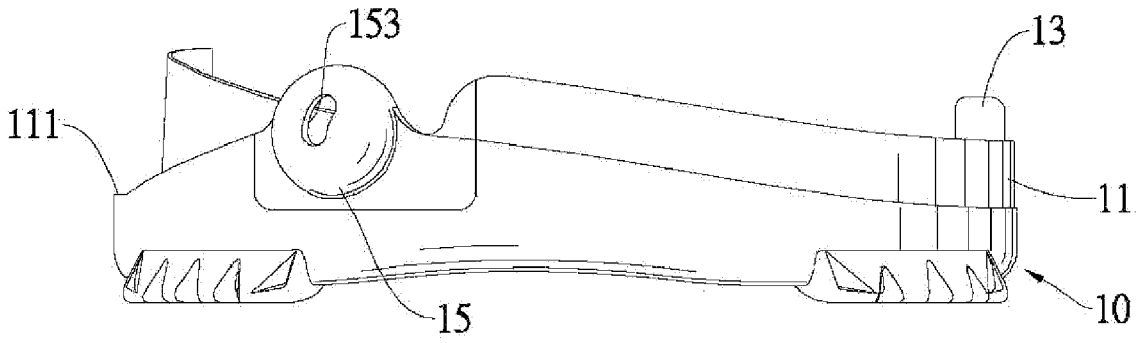
FIG. 5 is a side view of the rotate bottom base of the rotate bottom base assembly of the golf stand bag in FIG. 4.
Figure 6:
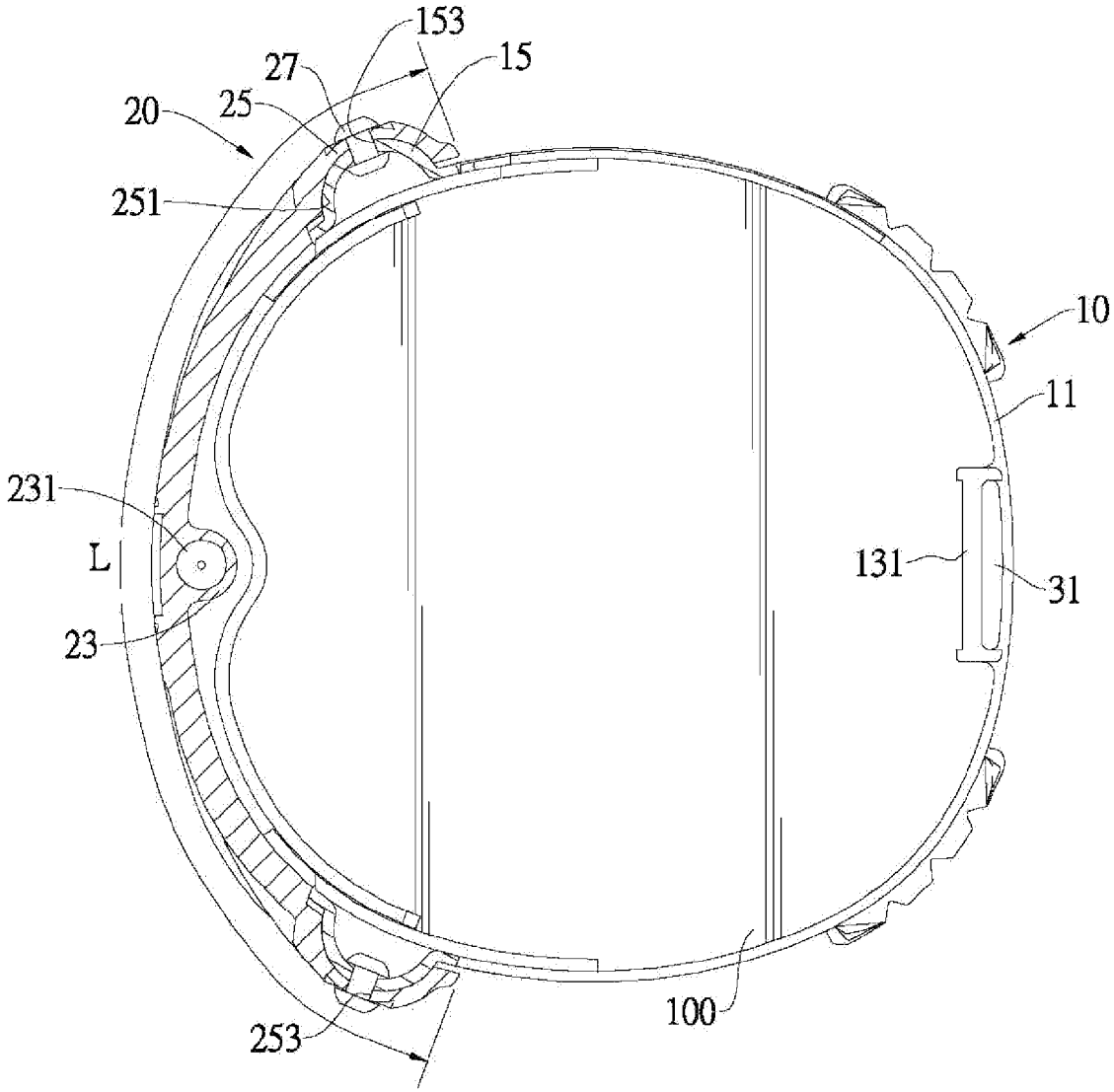
FIG. 6 is a top view of the rotate bottom base assembly of the golf stand bag in FIG. 4.

With further reference to FIGS. 5 and 6, the rotate bottom base (10) has a bottom (100), a sidewall (11) and two pivot balls (15) and may further have a mounting bracket (13).

The sidewall (11) is annular, is formed on and protrudes upward from the bottom (100) and may further have a stopper (111) formed on the sidewall (11).

The pivot balls (15) are formed on the sidewall (11). Each pivot ball (15) has a pivot slot (153) defined longitudinally through the pivot ball (15).

The mounting bracket (13) is formed on the sidewall (11), is opposite to the stopper (111) and the pivot balls (15) and has a mounting recess (131) defined in the mounting bracket (13).

Figure 7:
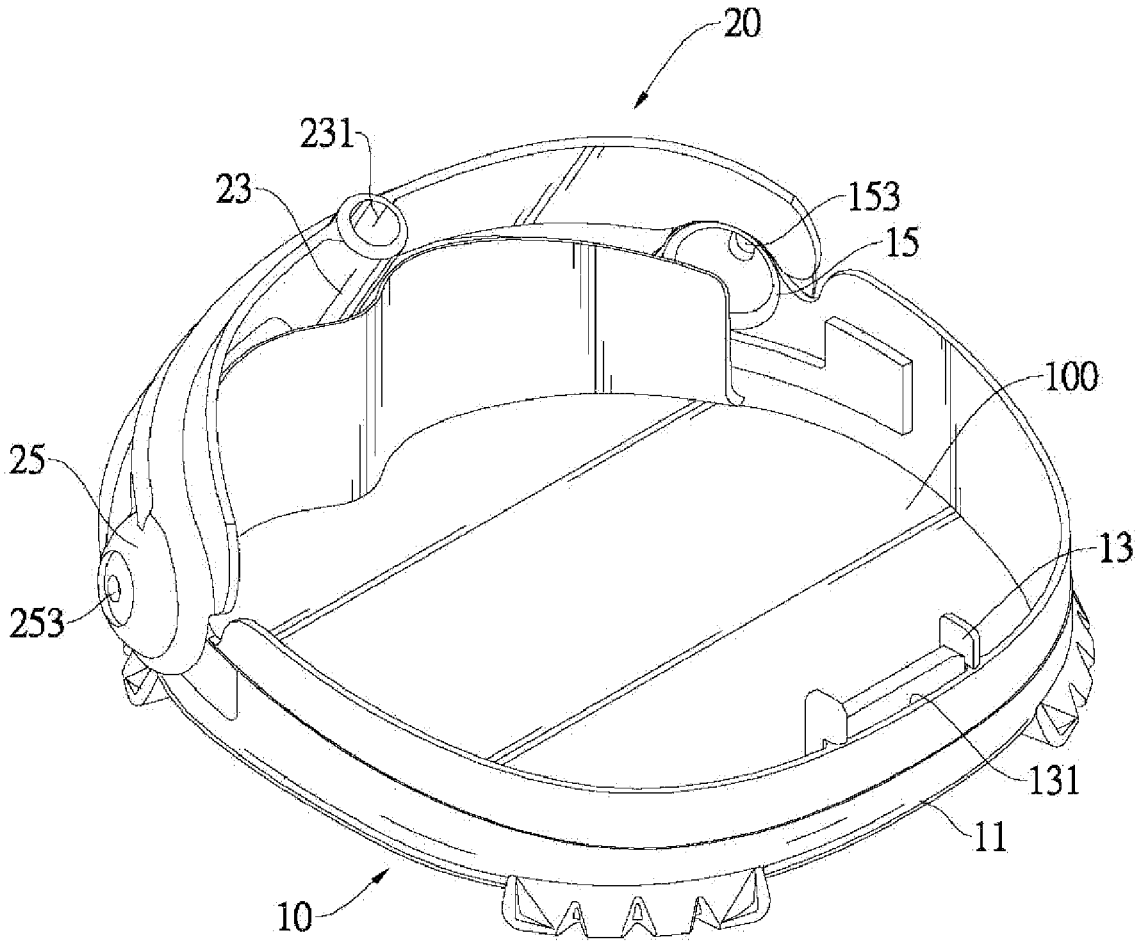
FIG. 7 is an operational perspective view of the rotate bottom base assembly in FIG. 2.
Figure 8:
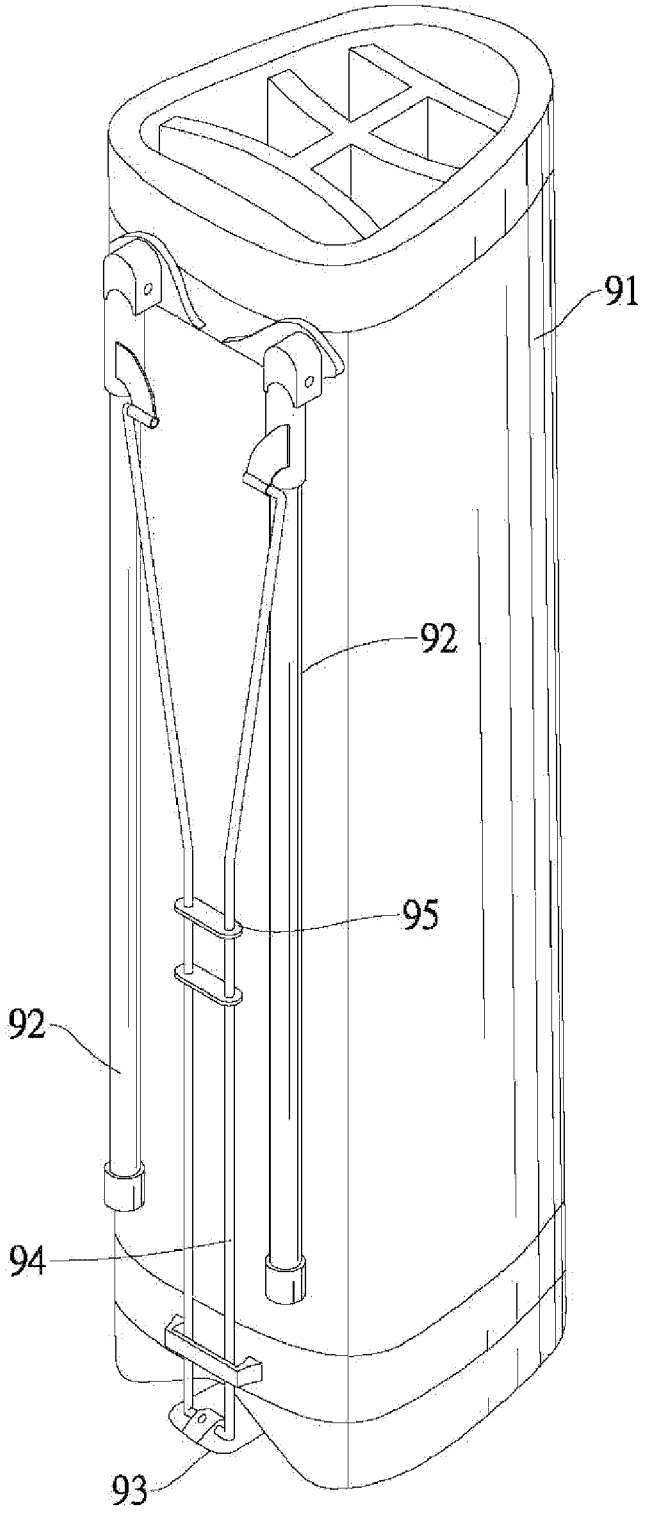
FIG.8 PRIOR ART
FIG. 8 is a perspective view of a conventional golf stand bag in accordance with the prior art.

The pivot bracket (20) is curved, is mounted pivotally on the sidewall (11), is located above the bottom (100) of the rotate bottom base and may be located above and selectively abut the stopper (111) of the rotate bottom base (10) to prevent the pivot bracket (20) from excessively pivoting down. The pivot bracket (20) has a length (L), two ends, two pivot member (25) and two pivot pintles (27) and may further have a mounting sleeve (23). The pivot pintles (27) are shown in FIGS. 4 and 7 however are omitted in remaining drawings for illustration purposes clearly showing other elements of the present invention.

The length (L) of the pivot bracket (20) is less than half of a circumference of the sidewall (11) of the rotate bottom base (10) to save material and prevent the pivot bracket (20) from inadvertently deforming due to an excessive length.

The pivot members (25) are formed respectively on the ends, correspond to and are pivotally mounted respectively on the pivot balls (15) of the rotate bottom base (10). Each pivot member (25) has a pivot socket (251) and a pivot hole (253). The pivot socket (251) is curved, is defined in the pivot member (25) and is engaged universally with a corresponding pivot ball (15) of the rotate bottom base (10). The pivot hole (253) is defined through the pivot member (25)

The pivot pintles (27) are mounted respectively through the pivot holes (253) of the pivot members (25) of the pivot bracket (20) and are slidably mounted respectively through the pivot slot (153) of the pivot balls (15) of the bottom fame (10). When the pivot bracket (20) pivots up relative to the rotate bottom base (10), the pivot pintles (21) slide in the pivot slot (153) of the rotate bottom base (10) to facilitate operation of the pivot bracket (20).

The mounting sleeve (23) is formed centrally on the pivot bracket (20) and has a mounting hole (231) defined in the mounting sleeve (23).

The supporting rod (30) is mounted securely on and protrudes upward from the pivot bracket (20), may be mounted in the mounting hole (231) of the mounting sleeve (23) of the pivot bracket (20) and has a bottom end and a top end. The bottom end is mounted in the mounting hole (231).

The top frame (40) is hollow and is mounted securely on the top end of the supporting rod (30).

The body (50) may be made of fabric, is mounted between the rotate bottom base (10) and the top frame (40), covers the supporting rod (30) and may have a binder (55) mounted on the body (50).

The legs (60) are mounted pivotally on the top frame (40) and selectively extend out to obliquely stand the golf stand bag on the ground.

The activating member (70) is U-shaped and resilient, is mounted on the rotate bottom base (10) opposite to the supporting rod (30), may be mounted in the mounting recess (131) of the mounting bracket (13) of the rotate bottom base (10) and has two activating rods (71).

The activating rods (71) are formed on the activating member (70), may extend slidably through the binder (55) of the body (50) and each activating rod has a connecting end connected pivotally to one leg (60).

Figure 2:
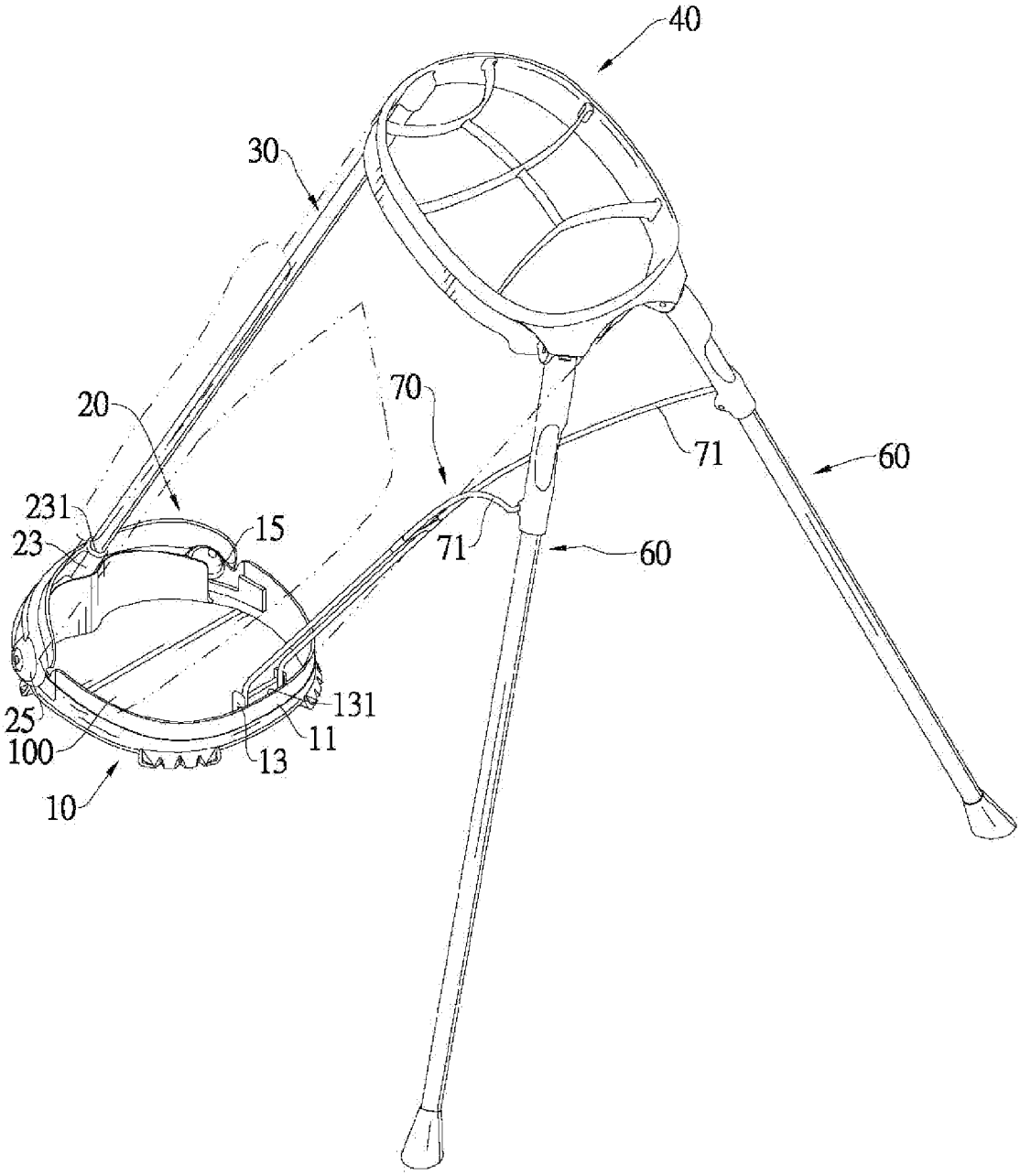
FIG. 2 is an operational perspective view of the golf stand bag in FIG. 1 with the legs extending to hold the golf stand bag obliquely on the ground.

With further reference to FIGS. 2 and 7, to obliquely stand the golf stand bag on the ground, the pivot bracket (20), supporting rod (30) and top frame pivots and incline. Simultaneously, the resilient activating rods (71) are bent to push the legs (60) to extend out and stand on the ground.

Because the pivot bracket (20) is mounted on the sidewall (12) of the rotate bottom base (10) instead of being exposed out of the bottom (100), the golf stand bag leaning on a wall would not press the pivot bracket (10) against the ground to inadvertently activate the pivot bracket (20) and extending the legs (60).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rotate bottom base assembly for a golf stand bag comprising:

a rotate bottom base having a bottom;

a sidewall being annular, formed on and protruding upward from the bottom; and two pivot balls, each having a hemispherical shape, formed on the sidewall and each pivot ball having a pivot slot defined longitudinally through the pivot ball; and a pivot bracket being curved, mounted pivotally on the sidewall, located above the bottom of the rotate bottom base and having two ends;

two pivot members formed respectively on the ends, corresponding to and pivotally mounted respectively on the pivot balls of the rotate bottom base and each pivot member having a pivot socket being curved, defined in the pivot member and engaged rotatably with a corresponding pivot ball of the rotate bottom base; and a pivot hole defined through the pivot member; and two pivot pintles mounted respectively through the pivot holes of the pivot members of the pivot bracket and slidably mounted respectively through the pivot slot of the pivot balls of the bottom frame.

2. The rotate bottom base assembly as claimed in claim 1, wherein the sidewall of the rotate bottom base further has a stopper formed on the sidewall; and the pivot bracket is located above and selectively abuts the stopper.

3. The rotate bottom base assembly as claimed in claim 2, wherein the rotate bottom base further has a mounting bracket formed on the sidewall and having a mounting recess defined in the mounting bracket.

4. The rotate bottom base assembly as claimed in claim 3, wherein a length of the pivot bracket is less than half of a circumference of the sidewall of the rotate bottom base.

5. The rotate bottom base assembly as claimed in claim 4, wherein the pivot bracket further has a mounting sleeve formed centrally on the pivotal bracket and having a mounting hole defined in the mounting sleeve.

6. A golf stand bag comprising:

a rotate bottom base assembly having a rotate bottom base having a bottom;

a sidewall being annular, formed on and protruding upward from the bottom; and two pivot balls, each having a hemispherical shape, formed on the sidewall and each pivot ball having a pivot slot defined longitudinally through the pivot ball;

a pivot bracket being curved, mounted pivotally on the sidewall, located above the bottom of the rotate bottom base and having two ends;

two pivot members formed respectively on the ends, corresponding to and pivotally mounted respectively on the pivot balls of the rotate bottom base and each pivot member having a pivot socket being curved, defined in the pivot member and engaged rotatably with a corresponding pivot ball of the rotate bottom base; and a pivot hole defined through the pivot member; and two pivot pintles mounted respectively through the pivot holes of the pivot members of the pivot bracket and slidably mounted respectively through the pivot slot of the pivot balls of the bottom frame;

a supporting rod mounted securely on and protruding upward from the pivot bracket and having a bottom end and a top end;

a top frame being hollow and mounted securely on the top end of the supporting rod;

a body mounted between the rotate bottom base and the top frame covering the supporting rod;

two legs mounted pivotally on the top frame and selectively extending out; and an activating member being resilient, mounted on the rotate bottom base opposite to the supporting rod and having two activating rods formed on the activating member and each activating rod having a connecting end connected pivotally to one leg.

7. The golf stand bag as claimed in claim 6, wherein the sidewall of the rotate bottom base further has a stopper formed on the sidewall; and the pivot bracket is located above and selectively abuts the stopper.

8. The golf stand bag as claimed in claim 7, wherein the rotate bottom base further has a mounting bracket formed on the sidewall and having a mounting recess defined in the mounting bracket; and the activating member is mounted in the mounting recess.

9. The golf stand bag as claimed in claim 8, wherein a length of the pivot bracket is less than half of a circumference of the sidewall of the rotate bottom base.

10. The golf stand bag as claimed in claim 9, wherein the pivot bracket further has a mounting sleeve formed centrally on the pivotal bracket and having a mounting hole defined in the mounting sleeve; and the bottom end of the supporting rod is mounted in the mounting hole.

11. The golf stand bag as claimed in claim 10, wherein the body further has a binder mounted on the body; and the activating rods of the activating member are mounted slidably through the binder.

* * * * *